United States Patent [19]

Huber et al.

[11] 4,150,353

[45] Apr. 17, 1979

[54] CURRENT LIMITING FUSE

[75] Inventors: William J. Huber, Racine; Stephen P. Hassler, Muskego; John V. Majewski, Hales Corners, all of Wis.

[73] Assignee: McGraw-Edison Company, Elgin, Ill.

[21] Appl. No.: 776,521

[22] Filed: Mar. 11, 1977

[51] Int. Cl.[2] ..... H01H 85/16

[52] U.S. Cl. ..... 337/231; 337/252

[58] Field of Search ..... 337/158, 160, 159, 161, 337/186, 203, 231, 232, 248, 249, 251, 250, 252

[56] References Cited

U.S. PATENT DOCUMENTS

| | | | |
|---|---|---|---|
| 3,243,552 | 3/1966 | Mikulecky | 337/160 X |
| 3,333,336 | 8/1967 | Cameron et al. | 337/248 X |
| 3,962,666 | 6/1976 | Knapp | 337/159 |
| 4,010,438 | 3/1977 | Scherer | 337/252 X |
| 4,063,208 | 12/1977 | Bernatt | 337/248 |

*Primary Examiner*—George Harris
*Attorney, Agent, or Firm*—Thomas E. McDonald; Ronald J. LaPorte; Jon Carl Gealow

[57] ABSTRACT

A full-range, current limiting fuse which includes a modular fuse subassembly which can be assembled with any pair of several types of paired end caps to construct any one of several types of fuses. This modular subassembly includes a main fuse element helically wound about a gas evolving spider and connected to element termination plates mechanically attached to each end of the spider, and an auxiliary fuse element, electrically isolated from the main element, which is also helically wound about the spider and connected at one end to a contact button centrally disposed at one end of the spider.

This modular subassembly is positioned within a sand-filled fuse tube sealed at both ends by brass end caps which are magnetically formed and epoxied thereon. The main fuse element is electrically connected at each end to a respective end cap by terminal tabs of the element terminations which extend through matching openings in the caps, and are soldered therein to hermetically seal the openings. One of these end caps includes a centrally disposed contact button which is electrically connected to an outside surface of the end cap by a high resistance vent wire extending through a passage in the end cap, and which makes electrical contact with the contact button of the modular subassembly to thus connect the auxiliary element to the outside surface of one of the end caps.

The fuse can be made watertight by positioning elastomeric gaskets between the caps and the tube which are compressed during the forming operation to form watertight seals, and by filling the vent wire passage in the end cap with elastomeric material. During a fuse operation, the vent wire is vaporized to produce a vent hole for gases generated within the fuse and to give indication of the fuse operation.

24 Claims, 8 Drawing Figures

FIG. 1
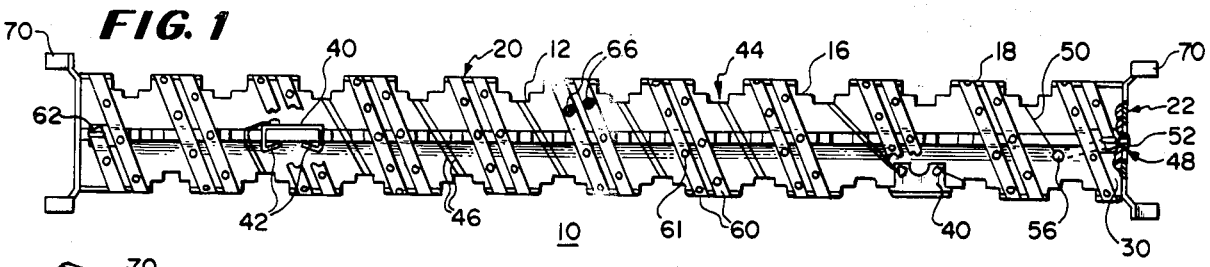
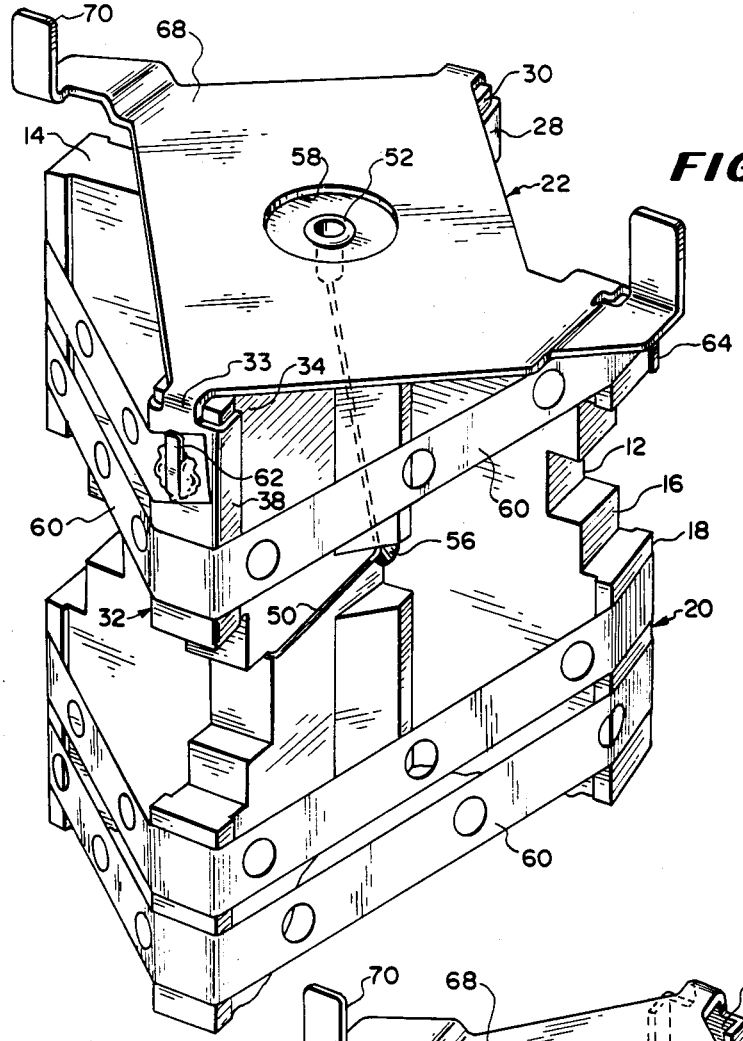
FIG. 2
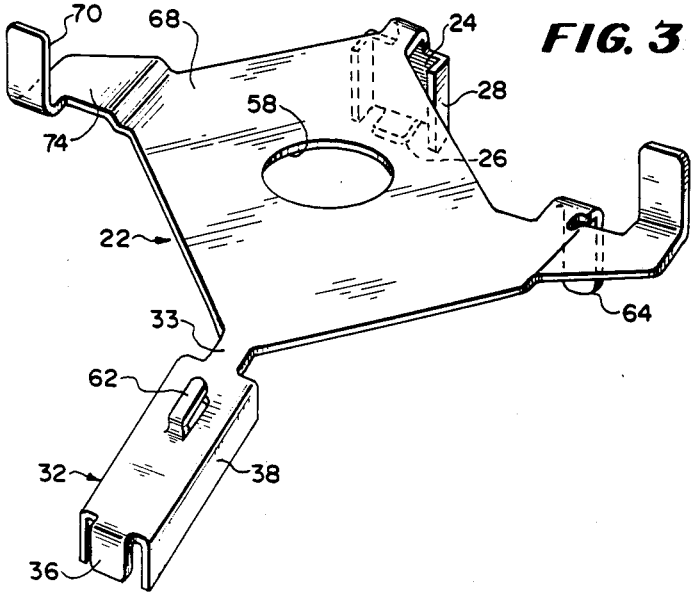
FIG. 3

CURRENT LIMITING FUSE

FIELD OF THE INVENTION

The invention relates generally to fuses, and, more particularly, to current limiting fuses having a modular type fuse assembly which can be used in several styles of fuses of the same rating.

DESCRIPTION OF THE PRIOR ART

In the manufacture of prior known full-range current limiting fuses having main and auxiliary fuse elements wound about a spider of gas a evolving material, such as the fuse described in U.S. Pat. No. 3,243,552, issued Mar. 29, 1966, to H. W. Mikulecky, end collar assemblies are first attached to a spider element with an epoxy adhesive, wherein considerable time is required for jigging the parts and curing the epoxy. Next the auxiliary fuse element is helically wound about the spider, and the ends of the auxiliary fuse elements are soldered to respective air gap electrodes positioned adjacent the path of the main fuse elements. Next, the free end of a high resistance indicator wire, attached at an opposite end to a cup shaped indicator slidably mounted within an axial bore of the collar assembly to hold this cup shaped indicator in a recessed position within the bore against the force exerted by an indicator spring to slide the indicator to a projecting position, is brought through an opening in the spider and attached to one of the air gap electrodes. When the fuse operates, this indicator wire is vaporized and an indicator spring moves the indicator to its projecting visible position to thus indicate fuse operation.

The main fuse element is then wound about the spider and its ends are soldered to respective end plates of each end collar assembly. Since different end collar assemblies are used for each style of fuse, the winding machine for winding the main and auxiliary fuse elements has to be adapted to each particular end collar assembly.

After winding and attaching the fuse elements, epoxy is applied to the periphery of the end collars and the fuse assembly is inserted into a fuse tube and positioned so that the collars are flush with the ends of the tube. The epoxy must then be allowed to cure at room temperature, which requires considerable time. Holes are then drilled through the fuse tube into the end collars and drive pins are inserted. The fuse tube is then filled with sand through two fill holes in one of the end collars. This filling operation requires a significant portion of the total fuse assembly time because of the relatively small size of the fill holes.

This prior known fuse is not weatherproof, in that neither the epoxy seal between the respective collar assemblies and the fuse tube nor the metal-to-metal contact between the end plates and the respective end collars is watertight. Also, water can seep into the interior of the fuse about the cup shaped indicator and through the passage provided for the indicator wire.

SUMMARY OF THE INVENTION

It is a primary object of the invention to provide a current limiting fuse which includes a modular fuse element subassembly, which can be assembled within a fuse tube with any pair of several types of paired end caps to construct any one of several styles of fuses.

It is a related object of the invention to provide a current limiting fuse which includes a modular fuse element subassembly comprising a fuse element support spider carrying resilient mounting members at each end thereof for correctly positioning the spider within a fuse tube and for mounting the ends of the spider to respective end caps to minimize breakage of the spider or fuse elements mounted thereon by forces transmitted through one of the end caps when the fuse receives rough handling.

It is another related object of the invention to provide a watertight, full-range current limiting fuse which is hermetically sealed until it operates, at which time a gas vent is created to relieve internal pressure generated by arc erosion of a gas evolving spider therein.

It is still another object of the invention to provide a hermetically sealed current limiting fuse suitable for operation while submerged in oil or other electrically insulating type liquids.

It is a further object of the invention to provide a method of manufacturing various styles of current limiting fuses which is easier and less time consuming than methods known heretofore.

Each of the current limiting fuses described herein includes an electrically insulating fuse tube, metallic terminals on the ends of the fuse tube, an inert granular material of high dielectric strength within the fuse tube, and a modular subassembly embedded in the inert granular material and connected between the fuse terminals within the fuse tube. The fuse terminal includes a metallic end cap having a cylindrical side wall which is magnetically formed about an adjacent end of the fuse tube over a layer of epoxy adhesive applied therebetween.

The modular subassembly of the current limiting fuses described herein includes a spider having a respective element termination end plate mechanically attached at each end thereof, and a main fuse element helically wound about the spider and attached at each end to a respective one of the element terminations.

Both element terminations have terminal end tabs which extend longitudinally from offset positions of the element terminations into radially spaced, matching openings in radially extending walls of respective metallic mounting members on the ends of the fuse tube. In a preferred embodiment, the end caps of the fuse terminals are also the mounting members for the modular subassembly. The terminal end tabs are used to correctly position the modular subassembly within a fuse tube during assembly, and resiliently connect each end of the module to a respective end cap, as well as to provide a good electrical connection between each end of the main fuse element and a respective end cap.

The modular subassembly of full range, current limiting fuses also includes an auxiliary fuse element, which is helically wound about the spider, and connected at each end thereof to respective air gap electrodes precisely spaced from the main fuse element. One of these air gap electrodes is electrically connected to a contact button, or eyelet, which is centrally disposed at one end of the spider, by a wire extending from the air gap electrode through a passage in the spider to the contact button. Also, in the modular subassemblies for full range current limiting fuses, at least those portions of the spider in contact with the main fuse element is of a material which evolves gas when it is arc eroded.

A first end cap is fitted over the end of an epoxy fiberglass fuse tube and is tightly sealed thereto by epoxy adhesive applied between the cap and the tube and by a subsequent step of magnetically forming the cap to the end of the tube.

For fuses designed for outdoor use, an elastomeric gasket is positioned under a stepped section of the end cap wall before forming the cap to the wall. Then when the cap is formed, this gasket is compressed between the cap and the fuse tube, forming a watertight seal.

The modular subassembly is then placed inside the fuse tube with the terminal end tabs passing through the matching openings in the end cap. The terminal end tabs are then folded over the outside of the cap and soldered thereto, both to provide good electrical contact and to hermetically seal the openings. The fuse is then filled with sand through the open end of the tube. This filling operation is quickly and easily performed because of the large tube opening.

After the filling operation, a second end cap is fitted over the open end of the fuse tube, with the remaining, opposite terminals end tabs of the fuse subassembly extending through matching openings in the second end cap. The second end cap is tightly sealed to the fuse tube by epoxy adhesive and magnet forming in the same manner as the first end cap, and the adjacent terminal end tabs of the fuse subassembly is connected to the second end cap in the same manner as the first cap and the end tabs were connected.

In the assembly of full range, current limiting fuses, the end cap disposed adjacent to the auxiliary element contact button of the modular subassembly includes a second centrally disposed contact button which makes contact with the first contact button when the fuse is assembled. This second contact button is electrically insulated from the surface of the end cap on which it is mounted, but is electrically connected to a point on the outside of the end cap spaced from a passageway therethrough by a high resistance vent wire extending through this passageway. For fuses designed for outdoor use, this vent passageway is filled with elastomeric material to hermetically seal this passage and to electrically insulate the vent wire from the walls of this passage. Thus, the auxiliary fuse element is electrically isolated from the fuse's normal current path except where it is connected to the outside of one of the end caps via the high resistance vent wire.

The primary reason for connecting the vent indicator wire on the outside of the end cap is to create a gas vent, when the fuse operates, to relieve internal pressure generated by the erosion of material from the fuse's gas evolving spider. When a fault current opens the main fuse element, the arc voltage developed across the opened ends of the main fuse element will cause the air gap between the main and auxiliary fuse elements on the side of the main fuse element opposite the side connected to the vent indicator wire to spark over, forcing the current flow to transfer to the auxiliary fuse element and vent wire circuit. Current flow through the relatively high resistance vent wire will cause this wire to be vaporized almost instantly, leaving a hole through the elastomeric plug in the vent hole through which gas generated by the arc erosion of the spider can escape to the surrounding atmosphere. Since the vent wire extends through the plug, examination of the condition of the wire between the outside surface of the plug and the location at which the vent wire is electrically attached to the end cap can also be used as an indicator to determine whether the fuse has operated.

In another embodiment of the invention, the mounting members for the modular subassembly are radially extending plates disposed at the ends of the fuse tube within the end caps of the fuse terminals. Each plate has opposite ends which are offset to form arcuate grooves, U-shaped in cross-section, which fit over and on both sides of an adjacent end of the fuse tube, and which are tightly held by the magnetically formed side wall of the adjoining end cap to produce good electrical contact therebetween.

BRIEF DESCRIPTION OF THE DRAWINGS

It is believed the invention will be better understood from the following detailed description and drawings in which:

FIG. 1 is a side view of a modular fuse subassembly of a current limiting fuse, according to the invention;

FIG. 2 is a perspective view of one end of the fuse element subassembly shown in FIG. 1;

FIG. 3 is a perspective view of one of the element terminations of the fuse element subassembly shown in FIG. 1;

DESCRIPTION OF PREFERRED EMBODIMENTS

Figure 4:
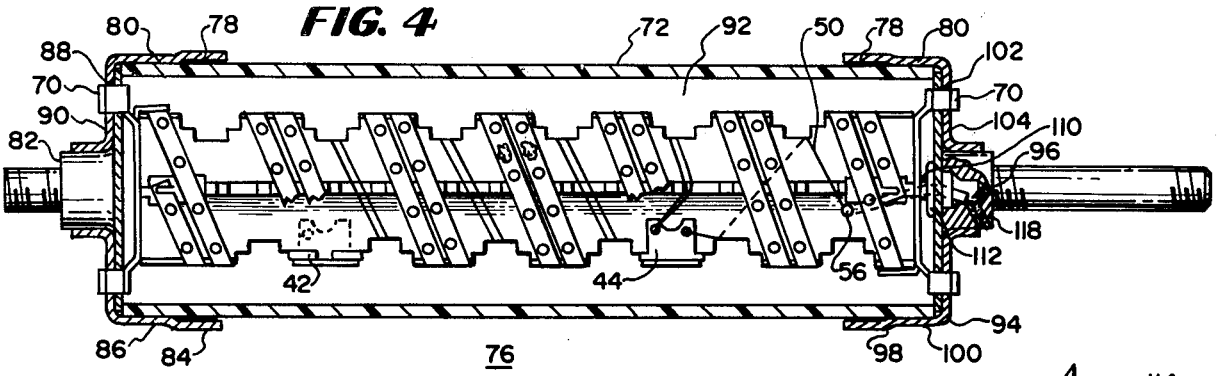
FIG. 4 is a side view, in partial cross section, of a watertight, full-range, current limiting, outdoor fuse.

Referring now to the drawings, the fuse element modular subassembly 10 shown in FIGS. 1 and 2 includes an elongated insulating core, or spider 12, having four radially protruding, peripherally spaced apart, longitudinally extending fins 14. Each fin 14 has a plurality of depressions 16 of semicruciform configuration spaced apart longitudinally of the spider 12 forming longitudinally spaced apart raised shoulders 18. The depressions 16 of the peripherally successive fins 14 are progressively staggered in a direction longitudinal of the spider 12 so that the peripherally successive depressions 16 define a continuous helical path and the peripherally successive raised shoulders 18 form support means of helical configuration for a circuit interrupting main fusible element 20. At least those portions of the spider 12 in contact with the main fusible element 20 are of an electrical insulating material adapted to evolve gas in the presence of an arc, such as disclosed in U.S. Pat. No. 3,437,971 issued Apr. 8, 1969, to H. W. Mikulecky.

In assembling the fuse element module 10, an element termination 22, shown in FIG. 3, is mechanically attached to the spider 12 by positioning a longitudinally extending portion 24 of the element termination 22 having end and side tabs 26, 28 extending radially inward, over and around a short raised end shoulder 30 of the spider 12, then bending down an opposite portion 32 of the element termination 22 at a necked section 33 to extend longitudinally over an opposite longer end shoulder 34 of the spider. This portion 32 of the element termination also has an end tab 36 and side tabs 38 which extend radially inward over the sides and end of the longer raised end shoulder 34 of the spider, to thereby securely fasten this element termination 22 to the end of the spider 12.

Two metallic clips, air gap electrodes 40, are fitted over respective raised shoulders 18 which are positioned about halfway between the midpoint and respective ends of the spider 12. The ends 42 of the clip electrodes 40 are resiliently urged against these raised shoulders 18 to prevent movement of the electrodes 40 relative to the spider 12. An auxiliary fusible element 44, such as the two wires 46 shown in the embodiment of FIG. 1, is spirally wound about the spider 12 in the helical path defined by the depressions 16, and each end of this auxiliary element 44 is electrically connected by suitable means such as solder to a respective air gap electrode 40. The free end of an auxiliary wire assembly 48, consisting of a wire 50 having one end crimped to an eyelet 52, is threaded through a passage 56 extending from the axial center of one end of the spider 12 to the periphery of the spider 12 at a point spaced from the end of the spider 12 intermediate the fins 14, and is pulled tight to secure the eyelet 52 against the end of the spider 12 within a circular opening 58 of the element termination 22. This wire 50 is then spirally wound about the spider 12 in the helical path defined by the depressions 16 therein, and electrically connected to the nearest air gap electrode 40.

The main fusible element 20 is then spirally wound about the spider 12 along the helical path defined by the peripherally successive raised shoulders 18, and electrically connected at each end to a respective element termination 22. In the embodiment of FIG. 1, this main fusible element 20 consists of two silver ribbons 60, provided with a plurality of circular perforations 61 spaced apart along the length thereof which determine the points where fusion of the element 20 is initiated when the fault current and its rate of rise are high. At each end of the spider 12, the end of one of the silver ribbons 60 is inserted between a raised offset tab 62 and the longitudinally extending portion 32 of the element termination 22 and the tab 62 is then bent inwardly to hold the ribbon 60. The end of the other silver ribbon 60 is inserted between a side of a peripherally successive adjacent fin 14 and an adjacent longitudinally extending tab 64 of the element termination 22 which is then bent inward to secure this ribbon 60. Solder is then applied to these end connections to assure good electrical contact between the element terminations 22 and the silver ribbons 60. As these ribbons 60 are wound about the spider 12, suitable means, such as the porous tape disclosed in U.S. Pat. No. 3,755,769 issued Aug. 28, 1973, to H. W. Mikulecky, disposed between the electrodes 40 and fuse ribbons 60, can be used to assure an accurate, predetermined, air gap between the air gap electrodes 40 and the main fusible element 20. After the main fusible element ribbons 60 have been wound about the spider 12 and connected at each end to the element terminations 22, beads 66 of low melting temperature alloy such as tin-lead solder, are placed on each ribbon 60 at approximately the midpoint thereof.

Each of the element terminations 22 have two oppositely disposed arm portions 68 which extend radially outward from the center of the element termination. Each of these arms 68 has a longitudinally extending mounting tab 70 which is mechanically connected to a selected one of various end cap terminations, which are thus assembled with this fuse element module 10 and a fuse tube 72 to make up one of several various styles of fuses. Each of these arm portions 68 has a radial offset section 74 to thus provide a more resilient mounting of the fuse element module 10 to these end caps, to reduce the chance of spider or element breakage due to forces transmitted through the end cap assembly when the fuse receives rough handling.

In assembling the watertight, full range, current limiting outdoor fuse 76 illustrated in FIG. 4, an elastomeric gasket 78 is slipped over the end and along the outer surface of an epoxy-fiberglass fuse tube 72. Then the outside surface of this fuse tube 72 between the elastomeric gasket 78 and the end of the tube 72 is coated with an epoxy adhesive 80, and a brass or copper alloy end cap 82 is fitted over this end of the tube 72, with the elastomeric gasket 78 being positioned beneath a stepped end portion 84 of the cylindrical side wall 86 of the cap 82. This end cap 82 is then subjected to a magnetic induction force which compresses the cylindrical side wall 86 of this cap inward against the fuse tube 72. A fuse element module 10, such as described above, is then inserted into the open end of the fuse tube 72, with the end of the module opposite the end carrying the auxiliary wire assembly being inserted first. The module 10 is then positioned in the tube 72 so that the mounting tabs 70 of the element termination 22 adjacent the end cap 82 extend through slots 88 in the end wall 90 of this cap 82, which serve to correctly position the module 10 within the fuse tube 72. These tabs 70 are then bent over into a adjacent recessed portion of the end wall 90 of this end cap 82 and the openings 88 are temporarily sealed by tape. The fuse tube 72 is then filled through its open end with a granular inert material 92 of high dielectric strength such as sand or finely divided quartz. After this filling operation, another elastomeric gasket 78 is slipped over the open end of the fuse tube 72, epoxy adhesive 80 is applied to the outer surface of the tube 72 between this gasket 78 and the end of the tube 72, and a second end cap 94, containing a vent-indicating wire assembly 96, is slipped over this end of the tube 72 with the elastomeric gasket 78 positioned beneath the stepped section 98 of the side wall 100 of this end cap 94. As with the first end cap 82, this second end cap 94 is positioned so that the mounting tabs 70 of the adjacent element termination 22 extends through slotted openings 102 in the second end cap 94. The second end cap 90 is then formed about this end of the tube 72 to compress the gasket 78 between it and the tube 72 to thereby produce a watertight seal between this cap 94 and the tube 72. The mounting tabs 70 extending through the second cap 94 are then bent down into a recessed portion of the end wall 104 of this cap 94, and these end slots 102 are filled with solder to hermetically seal these openings 102 as well as to make a good electrical connection between the element termination 22 adjacent the end cap 94.

Figure 5:
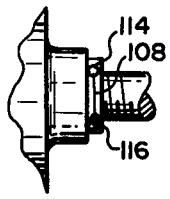
FIG. 5 is a partial side view of the vented end of the current limiting outdoor fuse of FIG. 4.

The second end cap 94 contains a vent-indicator wire assembly 96, similar to the indicator wire assembly 48 of the fuse element module 10 discussed above. A vent wire 108 of high resistance material such as tungsten or nichrome is connected at one end to an eyelet 110 centrally disposed on the inner side of the end wall 104 of this end cap 94 so that it makes contact with the eyelet 52 of the auxiliary wire assembly 48 of the fuse element module 10. This eyelet 110 is mounted on an insulating washer 112 held by the end cap 94 to electrically insulate the eyelet 110 and vent wire 108 from the end cap 94 at this point. This vent wire 108 extends through a passage 114 in the end cap 94 to the outside of the cap 94, and is electrically connected by the solder to the outside surface of this cap 94 at a point 116 spaced from this passage 114, as shown in FIG. 5. This passage 114 through the end cap 94 is filled with an insulating sealing material 118, such as epoxy or elastomeric material, to thus hermetically seal this opening 114 in the fuse 76 and also to insulate the vent wire 108 from the walls of this passage 114.

The tape is then removed from the bent over mounting tabs 70 at the other end of the fuse 76, and solder is applied to fill the slots 88 in this end cap 82 also, to thereby produce a completely hermetically sealed fuse. The epoxy adhesive layers 80 are then cured to produce a strong bond between the fuse tube 72 and each of the end caps 82, 94. It may be preferable to first assemble the end cap 94 to the tube 72 rather than the cap 82, in that contact between the eyelets 52, 110 can be more easily established, and maintained by bending the tabs 70 against a recessed outside portion of the cap 94.

The operation of a full range, current limiting fuse, that is a fuse which will clear any steady state current that will open its elements, including all current levels which exceed the continuous current carrying rating of the fuse, is fully described in the above-referenced U.S. Pat. No. 3,243,552 and 3,437,971, and thus will only briefly be discussed herein. Once a low level fault current opens the main fusible element 20 at its "M" spots 66, an arc will develop across the opening. Since one side of the auxiliary fusible element 44 is connected to one of the end cap terminals 94 through the auxiliary wire 50 and the vent indicator wire 108, the voltage of the arc across the open section of the main fusible element 20 will appear across the air gap between the other end of the auxiliary fusible element 44 and the main element 20. This arc voltage will increase as the length of the arc increases, eventually causing the air gap at the unconnected end of the auxiliary element 44 to spark over and force the current flow to transfer to the auxiliary indicator circuit 44, 48, 96. Current flow through the relative high resistance vent wire 108 will cause this wire to be vaporized almost instantly, leaving a hole in the elastomeric plug 118 in the vent hole 114, which relieves the internal pressure generated within the fuse tube 72 by the erosion of material from the gas-evolving spider 12, and also transferring the current flow back to the main element 20. Since the vent wire 108 extends through the plug 118, examination of the condition of the wire 108 between the outside surface of the plug 118 and the point 116 at which this wire 108 is soldered to the outside of the end cap 94 can also be used as an indicator to determine whether the fuse 76 is operated.

Figure 6:
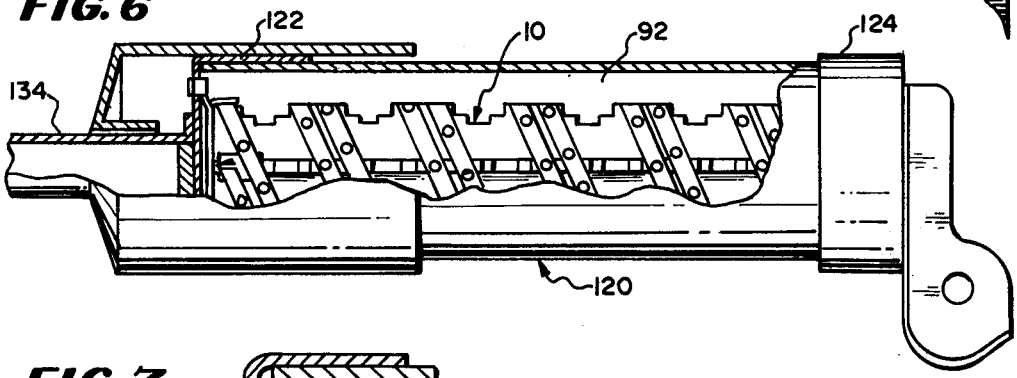
FIG. 6 is a side view, in partial cross section, of an indoor, hinged style fuse, according to the invention.

During the forming of the end caps 82, 94, to the fuse tube 72, the cylindrical side walls 86, 100 of the end caps 82, 94 are compressed against the tube 72 so rapidly that air can be trapped within the epoxy adhesive coating 80 between the caps 82, 94 and the tube 72, which can prevent the formation of watertight seals between the caps 82, 94 and the tube 72. Also, even if airtight seals are formed initially, when such fuses are used outdoors, water can enter into open channels or voids at the end of one of the end caps 82, 94. At a later date, during cold weather, this water can freeze to further expand these passages and break the seal between this cap and the tube 72. For this reason, on all outdoor weatherproof fuses, an elastomeric gasket 78 is placed between each cap 82, 94 and the tube 72 at the end of the cylindrical side walls 86, 100 of the cap 82, 94 to thus hermetically seal the unit 76 and prevent the entrance of water into any voids or air spaced in the epoxy adhesive coating 80. However, on indoor fuses, such as the hinge style indoor fuse 120 illustrated in FIG. 6, which do not need to be watertight, these elastomeric gaskets 78, as well as the elastomeric plugs 118 sealing the vent hole 114, can be omitted. Otherwise, the steps of assembling an inside fuse is basically the same as that described above for an outdoor fuse. An end cap 124 is epoxied and formed onto the end of a fuse tube 72, the fuse element module 10 is inserted in the tube 72 and attached to the end cap 124, the tube 72 is filled with sand 92, a second end cap 122 is fitted onto the open end of the fuse tube 72, attached to the fuse element module 10, and epoxied and formed thereon. Since there is no need to hermetically seal the passage 114 in the end cap 124 through which the indicator wire 108 extends, the hinged end cap 124 of this indoor fuse 120, shown in better detail in FIG. 7, can include a fuse operation indicator similar to that disclosed in the above-referenced U.S. Pat. No. 3,243,552. This end cap 124 contains an indicator wire assembly similar to the vent-indicator wire assembly 96 discussed above, wherein a high resistance vent wire 108 has one end connected to an eyelet 110 which is mounted to, and insulated from, the end cap 124 by an insulating washer 112, and which makes contact with the eyelet 52 of the auxiliary wire assembly 48 of the fuse element module 10. The other end of this vent wire 108 is connected to a cup shaped indicator 126 which is normally disposed within an axial bore 128 in the end cap 124 and is urged outward therefrom to a visible position by a compression spring 130. The indicator wire 108 normally holds the indicator 126 in the inward position wherein the spring 130 is compressed between the indicator 126 and the end cap 124. The end cap 124 has inner and outer flanges 132, 134 extending into the axial bore 128 to limit the axial travel of the indicator 126 and prevent it from being removed from the bore 128. During an operation of the fuse 120, the indicator wire 108 is vaporized almost instantaneously, thereby permitting the spring 130 to urge the indicator 126 to a visible position as an indication that the fuse 120 has operated. The end cap 122 at the other end of this fuse 120 includes a tubular metallic terminal member 134 adapted to fit within a stationary contact jaw (not shown) of an electrical switch, similar to that described in the above-mentioned U.S. Pat. No. 3,243,552.

This type of fuse element modular construction can also be used for a current limiting fuse which does not have a full range fault clearing capability, which has only a main fusible element and does not require a gas evolving spider. Such a fuse element module would be constructed basically the same as that described above for a full range fuse, except that the air gap electrodes 40, the auxiliary fusible element 44, and the auxiliary wire assembly 48 would be omitted from the subassembly 10, as illustrated in the stud-mounted current limiting fuse 138 shown in FIG. 8, which is designed for operation while immersed in electrically insulating oil or other insulating liquid medium.

Figure 8:
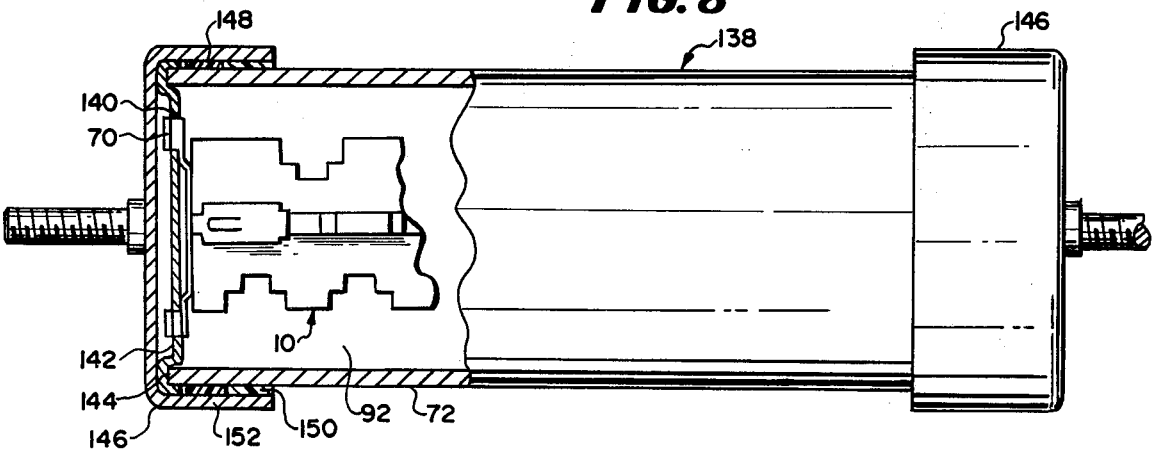
FIG. 8 is a side view, partially in cross section, of an oil immersible, stud type current limiting fuse according to the invention.

FIG. 8 also illustrates an alternate way of connecting the mounting tabs 70 of each element termination 22 to its respective end cap. In this alternate method, the mounting tabs 70 of one of the element terminations 22 of the fuse element assembly 10 extend through slots 140 in an interconnecting electrically conductive member 142, and are bent over and soldered thereto. Each end of this interconnecting piece 142 is offset to produce therein an arcuate groove 144, U-shaped in cross section, which fits over and on both sides of the end of the fuse tube 72, to thereby accurately position the fuse element module 10 within the tube 72. Then, when the end cap 146 is formed about the end of the tube 72, it also makes a good electrical connection with this interconnecting piece 142.

Figure 7:
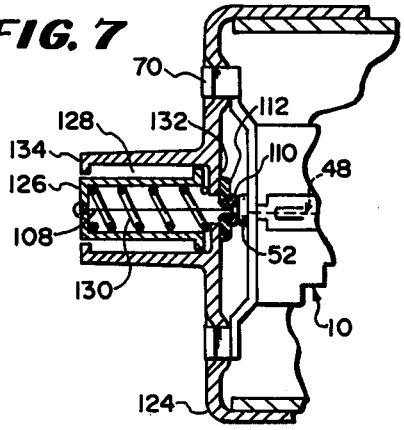
FIG. 7 is a cross-sectional side view of one end of an indoor current limiting fuse, illustrating a fuse operation indicator.

In assembling the oil immersible fuse 138 depicted in FIG. 7, an elastomeric gasket 148 of a material, such as "Viton", which is suitable for use in hot oil, is slipped over the end of a fuse tube 72 and positioned on the outside of this tube 72 about 1/16 of an inch from the end, to thus leave space for the end of the interconnecting member 142 to fit over the tube 72. A layer of epoxy adhesive 150 is then applied to the outside of the fuse tube 72 on the side of the elastomeric gasket 148 removed from the end of the tube 72. Next, a fuse element module 10, having one set of its mounting tabs 70 attached to the interconnecting member 142 as described above, is inserted into the tube 72, and positioned so that the ends of the interconnecting member 142 extend over the edge of the tube 72 adjacent the elastomeric gasket 148. An end cap 146 is then slid over this end of the tube 72, and magnetically formed thereto to produce a strong oiltight seal between the cap 146 and the fuse tube 72. Since this fuse 138 is designed to operate under hot oil, there is no danger of water entering voids or air pockets in the epoxy coating 150 and freezing therein. The elastomeric sealing gasket 148 is placed close to the closed end of the end cap 146 rather than at the open end, since the compressive force applied to the side walls 152 of the end cap 146 at the closed end of the cap 146 is larger than that applied at the open end. Also, in this arrangement, the epoxy layer 150 offers at least some degree of protection to the elastomeric gasket 148 against contact with the hot oil surrounding the fuse 138.

After sealing the first cap 146 to the end of the fuse tube 72, a second oil resistant elastomeric gasket 148 is slipped over the other end of the fuse tube 72 and a second interconnecting member 142 is positioned over the open end of the tube 72 so that the mounting tabs 70 at this end of the fuse element module 10 extend through the matching slots 140 in the second interconnecting member 142. These mounting tabs 70 are then bent over and soldered to the second interconnecting member 142, and the tube 72 is filled with sand 92 or other inert granular material. Epoxy adhesive 150 is then applied around the outside of this tube behind the second elastomeric gasket 148 and a second end cap 146 is magnetically formed about this end of the tube 72 to produce a good electrical connection between it and the interconnecting member 142 and to compress the second elastomeric ring 148 between the second cap 146 and the tube 72, to thus produce an oiltight seal between the second cap 146 and the fuse tube 72. The epoxy adhesive 150 is then cured to produce a strong bond between the fuse tube 72 at each of the end caps 146.

While only a few embodiments of the invention have been illustrated and described, many modifications and variations thereof will be readily apparent to those skilled in the art, and consequently it is intended in appended claims to cover all such modifications and variations which fall in the scope of the invention.

What is claimed is:

1. In a current limiting fuse which includes a tubular insulating casing, metallic terminals on the ends of said casing, an inert granular material of high dielectric strength within said casing, an insulating spider, extending parallel to the axis of said casing and being embedded in said inert granular material, fastening means connecting each end of said spider to a respective one of said terminals, a main fusible element helically would about said spider, connecting means for electrically connecting each end of said main fusible element to a respective one of said terminals, the improvement wherein said fastening and connecting means comprise:

metallic mounting members on the ends of said casing, each mounting member having a radially extending wall which defines at least one radially spaced opening therethrough; and electrically conductive element terminations, mechanically attached to each end of said spider, each element termination being electrically connected to a respective end of said main fusible element and each element termination including at least one radially extending portion having an end tab which extends longitudinally through said radially spaced opening of an adjacent one of said mounting members, to center said spider within said casing, said end tab being connected to said adjacent mounting member within said opening:

whereby said spider is resiliently mounted at each end within said tubular casing.

2. In a current limiting fuse which includes a tubular insulating casing, metallic terminals on the ends of said casing, an inert granular material of high dielectric strength within said casing, an insulating spider, extending parallel to the axis of said casing and being embedded in said inert granular material, said spider having peripherally spaced apart, radially protruding fins extending longitudinally thereof, said fins having depressions spaced apart longitudinally thereof, fastening means connecting each end of said spider to one of said terminals, a main fusible element helically wound about said spider, connecting means for electrically connecting each end of said main fusible element to one of said terminals, the improvement wherein said fastening and connecting means comprise:

a pair of metallic mounting members, one of which is attached to each end of said casing, each mounting member having a radially extending wall defining at least one radially spaced opening therethrough; and a pair of electrically conductive element terminations, one of which is mechanically attached to each end of said spider, each element termination being electrically connected to an end of said main fusible element and including at least one radially extending portion having an end tab which extends longitudinally through said radially spaced opening in one of said mounting members to center said spider within said casing, said end tab being connected to said mounting member within said opening, each element termination having peripherally spaced apart portions, each of which extend longitudinally over a fin of said spider, the end of each longitudinally extending portion being bent radially inwardly into a depression of said fin to thus mechanically connect each element termination to an end of said spider, each longitudinally extending portion of said element terminations also having side tabs which extend radially inward along each radially extending side of a fin of said spider to thus prevent rotation of each element termination relative to said spider;

whereby said spider is resiliently mounted at each end within said tubular casing by said radially extending portions of said element terminations.

3. In a current limiting fuse which includes a tubular insulating casing, metallic terminals on the ends of said casing, an inert granular material of high dielectric strength within said casing, an insulating spider, extending parallel to the axis of said casing and being embedded in said inert granular material, fastening means connecting each end of said spider to an adjacent one of said terminals, a main fusible element helically wound about said spider, and connecting means for electrically connecting each end of said main fusible element to an adjacent one of said terminals, the improvement wherein said fastenting and connecting means comprise:

a pair of mounting members, one of which is attached to each end of said casing, each mounting member having a radially extending wall defining at least one radially spaced opening therethrough; and a pair of electrically conductive element terminations, one of which is mechanically attached to each end of said spider, each element termination being electrically connected to an adjacent end of said main fusible element and including at least one radially extending portion having an end tab which extends longitudinally through said radially spaced opening in an adjacent one of said mounting members to center said spider within said casing, said end tab being connected to said adjacent mounting member within said opening;

wherein said at least one radially extending portion of each element termination includes a longitudinally offset portion spaced from said end tab, to increase the resiliency of the mounting between said spider and said mounting members.

4. An improved current limiting fuse, as described in claim 1, which further comprises:

a layer of epoxy adhesive applied between said terminals and said casing to produce a strong bond therebetween; and said terminals each comprising a metallic end cap having a cylindrical side wall magnetically formed about a respective end of said casing with said adhesive layer therebetween, to tightly seal said casing.

5. An improved current limiting fuse, as described in claim 4, wherein said terminals are also said mounting members, and said end tabs are connected to said terminals within said openings thereof by solder applied therein, whereby said openings are hermetically sealed.

6. An improved current limiting fuse, as described in claim 4, wherein each mounting member comprises a radially extending plate having opposite ends which are offset to produce therein respective arcuate grooves, U-shaped in cross section, which fit over and on both sides of an end of said casing within one of said end caps, said ends of said mounting member being tightly held by said magnetically formed side wall of said end cap to produce a good electrical contact therebetween.

7. An improved current limiting fuse, as described in claim 4, wherein said cylindrical side wall of each end cap has a stepped, open end portion having a larger inner diameter than the remaining portion of said side wall, and the fuse further comprises an elastomeric gasket disposed between said stepped side wall portion of each end cap and said casing, which is tightly compressed by said magnetically formed side wall to produce a watertight seal between each end cap and said casing.

8. An improved current limiting fuse, as described in claim 4, which further comprises an elastomeric gasket of a material suitable for use in hot oil, positioned about said casing adjacent each end of said tube between said layer of epoxy and said casing end, which is tightly compressed by said magnetically formed side wall to produce an oiltight seal between each end cap and said casing, said layer of epoxy providing at least some protection to said gasket against contact with oil when said fuse is immersed in same.

9. A full range current limiting fuse, which comprises:

a tubular insulating casing;

epoxy adhesive, applied to an outer periphal surface of said casing at each end thereof;

a first metallic end cap having a cylindrical side wall, which is magnetically formed about one end of said casing, with said epoxy adhesive disposed therebetween to produce a strong bond between said first end cap and said casing;

a second metallic end cap, having a cylindrical side wall which is magnetically formed about an opposite end of said casing, with said epoxy bond between said second end cap and said casing, said second end cap having an end wall which defines a passage therethrough;

an insulating washer carried by said end wall of said second end cap at an inner end of said passage;

a first, axially disposed, electrical contact mounted on said insulating washer;

a high resistance wire disposed within said passage, having one end electrically connected to said first electrical contact and an opposite end electrically connected to said second end cap, at a point spaced from said passage;

a pair of metallic mounting members, one of which is attached to each end of said casing, each mounting member having a radially extending wall defining at least one radially spaced opening therethrough;

an inert granular material of high dielectric strength within said casing; and a modular subassembly, embedded in said inert granular material, which includes an insulating spider, extending parallel to the axis of said casing wherein at least one portion of said spider is of an electrical insulating material adapted to generate gas in the presence of an arc, a main fusible element which is helically wound about said spider, in contact with said portion of said spider adapted to generate gas in the presence of an arc, a body of low melting temperature alloy in intimate contact with said main fusible element, an auxiliary fusible element helically wound about said spider, having its ends spaced slightly from portions of said main fusible element on opposite sides of said body of alloy and forming air gaps with said main fusible element, a second electrical contact, which is axially disposed at one end of said spider, against said first electrical contact, an auxiliary wire having one end connected to one end of said auxiliary fusible element and an opposite end connected to said second electrical contact, and a pair of electrically conductive element terminations, one of which is attached to each end of said spider, each element termination being electrically connected to an end of said main fusible element and including at least one radially extending portion having an end tab which extends longitudinally through said radially spaced opening in one of said mounting members, to center said spider within said casing, said end tab being connected to said mounting member within said opening to maintain contact between said first and second electrical contacts.

10. An improved current limiting fuse, as described in claim 9, wherein said second end cap further comprises:

a fuse operation indicator, disposed within an axial bore defined by said second end cap and movable between a retracted position and an extended position;

a spring means disposed between said indicator and said end wall of said second end cap, for exerting a force to move said indicator to its extended position;

and said high resistance wire, having its end opposite the end connected to said first electrical contact, connected to said indicator, to hold said indicator in its retracted position against the force exerted by said spring means;

whereby said high resistance wire vaporizes during operation of the fuse, to allow said spring means to move said indicator to its extended position, thus providing visible indication of fuse operation.

11. An improved full range current limiting fuse, as described in claim 9, wherein said cylindrical side wall of each end cap has a stepped, open end portion having a larger inner diameter than the remaining portion of said side wall, and said fuse further comprises:

an elastomeric gasket disposed between said stepped side wall portion of each end cap and said casing which is tightly compressed by said magnetically formed side wall to produce a watertight seal between each end cap in and said casing; and a plug of insulating sealing material surrounding said high resistance wire and filling said passage to hermetically seal said passage and further to electrically insulate said high resistance wire from said terminal end wall;

whereby said high resistance wire vaporizes during operation of the fuse, creating a vent hole through said sealing plug to relieve internal pressure in the fuse and provide visible indication of the fuse operation.

12. An improved, watertight, full range, current limiting fuse, as described in claim 11, wherein said end caps are also said mounting members, and said end tabs are connected to said end caps within said openings thereof by solder applied therein, whereby said openings are hermetically sealed.

13. An improved watertight full range current limiting fuse, as described in claim 9, wherein each mounting member comprises a radially extending plate having opposite ends which are offset to produce therein arcuate grooves, U-shaped in cross section, which fit over and on both sides of one end of said tube within one of said end caps, said ends of said mounting member being tightly held by said magnetically formed side wall of said end cap to produce electrical contact therebetween.

14. An improved full range current limiting fuse, as described in claim 9, which further comprises means for exerting a force to maintain said first electrical contact against said second electrical contact, wherein said at least one radially extending portion of each element termination includes a longitudinally offset portion spaced from said end tab, said radially extended portions being loaded to exert said force.

15. An improved current limiting fuse, as described in claim 2, which further comprises:

a layer of epoxy adhesive applied between said terminals and said casing tube to produce a strong bond therebetween; and said terminals, each comprising a metallic end cap having a cylindrical side wall magnetically formed about a respective end of said casing with said adhesive layer therebetween, to tightly seal said casing.

16. An improved current limiting fuse, as described in claim 15, wherein said terminals are also said mounting members, and said end tabs are connected to said terminals within said openings thereof by solder applied therein, whereby said openings are hermetically sealed.

17. An improved current limiting fuse, as described in claim 15, wherein each mounting member comprises a radially extending plate having opposite ends which are offset to produce therein arcuate grooves, U-shaped in cross section, which fit over and on both sides of an end of said casing within one of said end caps, said ends of said mounting member being tightly held by said magnetically formed side wall of said end cap to produce a good electrical contact therebetween.

18. An improved current limiting fuse, as described in claim 15, wherein said cylindrical side wall of each end cap has a stepped, open end portion having a larger inner diameter than the remaining portion of said side wall, and the fuse further comprises an elastomeric gasket disposed between said stepped side wall portion of each end cap and said casing, which is tightly compressed by said magnetically formed side wall to produce a watertight seal between each end cap and said casing.

19. An improved current limiting fuse, as described in claim 15, which further comprises an elastomeric gasket of a material suitable for use in hot oil, positioned about said casing adjacent each end of said casing between said layer of epoxy and said end of said casing, which is tightly compressed by said magnetically formed side wall to produce an oiltight seal between each end cap and said casing, said layer of epoxy providing at least some protection to said gasket against contact with oil when said fuse is immersed in same.

20. An improved current limiting fuse, as described in claim 3, which further comprises:

a layer of epoxy adhesive applied between said terminals and said tube to produce a strong bond therebetween; and said terminals, each comprising a metallic end cap having a cylindrical said wall magnetically formed about a respective end of said casing with said adhesive layer therebetween, to tightly seal said casing.

21. An improved current limiting fuse, as described in claim 20, wherein said terminals are also said mounting members, and said end tabs are connected to said terminals within said openings thereof by solder applied therein, whereby said openings are hermetically sealed.

22. An improved current limiting fuse, as described in claim 20, wherein each mounting member comprises a radially extending plate having opposite ends which are offset to produce therein arcuate grooves, U-shaped in cross section, which fit over and on both sides of an end of said casing within one of said end caps, said ends of said mounting member being tightly held by said magnetically formed side wall of said end cap to produce a good electrical contact therebetween.

23. An improved current limiting fuse, as described in claim 20, wherein said cylindrical side wall of each end cap has a stepped, open end portion having a larger inner diameter than the remaining portion of said side wall, and the fuse further comprises an elastomeric gasket disposed between said stepped side wall portion of each end cap and said casing, which is tightly compressed by said magnetically formed side wall to produce a watertight seal between each end cap and said casing.

24. An improved current limiting fuse, as described in claim 20, which further comprises an elastomeric gasket of a material suitable for use in hot oil, positioned about said casing adjacent each end of said casing between said layer of epoxy and said end of said casing, which is tightly compressed by said magnetically formed side walls to produce an oiltight seal between each end cap and said casing, said layer of epoxy providing at least some protection to said gasket against contact with oil when said fuse is immersed in same.

* * * * *